US006006728A

United States Patent [19]

Matsuda et al.

[11] Patent Number: 6,006,728

[45] Date of Patent: Dec. 28, 1999

[54] FUEL INJECTION SYSTEM OF ENGINE FOR MODELS

[75] Inventors: Norio Matsuda; Kazuyuki Tanaka, both of Mobara, Japan

[73] Assignee: Futaba Denshi Kogyo K.K., Mobara, Japan

[21] Appl. No.: 08/961,149

[22] Filed: Oct. 30, 1997

[51] Int. Cl.[6] ..... F02M 37/04

[52] U.S. Cl. ..... 123/472; 251/129.17

[58] Field of Search ..... 123/472, 458, 123/510, 467; 251/129.17, 129.15, 129.01

[56] References Cited

U.S. PATENT DOCUMENTS

| | | | |
|---|---|---|---|
| 4,250,892 | 2/1981 | Sutton | 123/472 |
| 4,732,362 | 3/1988 | Morioka | 251/129.17 |
| 4,830,286 | 5/1989 | Asslaender | 251/129.17 |
| 4,944,487 | 7/1990 | Holterman | 251/129.17 |
| 5,070,845 | 12/1991 | Audenko | 123/472 |
| 5,216,273 | 6/1993 | Doering | 251/129.17 |
| 5,277,399 | 1/1994 | McCabe | 251/129.17 |
| 5,707,039 | 1/1998 | Hamilton | 251/129.17 |
| 5,797,586 | 8/1998 | Schulte | 251/129.17 |

FOREIGN PATENT DOCUMENTS

| | | | |
|---|---|---|---|
| 4-031662 | 2/1992 | Japan | 123/472 |
| 0312102 | 8/1971 | U.S.S.R. | 251/129.17 |

*Primary Examiner*—Carl S. Miller

*Attorney, Agent, or Firm*—Oblon, Spivak, McClelland, Maier & Neustadt, P.C.

[57] ABSTRACT

A fuel injection system having no fuel leakage and a high speed response includes both an outlet opening of a fuel supply passage 44 and an inlet opening 59 of an injection passage 56 are provided facing to a communication space 54 formed on the one end face of a valve box 51. A diaphragm 62 seals the communicating space of a valve box 51. A ridge 64 of the diaphragm 62 shuts the supply passage and injection passage. A valve body 70 driven by a solenoid coil 65 is combined with the diaphragm 62. The valve body 70 is pressed by a plate spring 71. While a current is not supplied to the solenoid coil 65, the plate spring 71 presses the valve body 70, and the ridge 64 of the diaphragm 62 closes the inlet opening 59 of the injection passage 56. Fuel is not injected. While a current is supplied to the solenoid coil 65, the valve body 70 is attracted toward a magnetic core 66. The ridge 64 leaves from the valve box 51, and the injection passage 56 is communicated to the supply passage 55 through the communication space 54. Fuel is injected. The valve body 70 does not receive resistance force from fuel, and a small force of the solenoid coil is sufficient for functioning. Fuel does not enter into the box 53, therefore fuel does not leak from a hole 69 for guiding a power supply wire 68 to the outside.

4 Claims, 6 Drawing Sheets

FUEL INJECTION SYSTEM OF ENGINE FOR MODELS

BACKGROUND OF THE INVENTION

1. Field of the Invention

This invention relates to an electronic controlled fuel injection system provided to an engine for models.

2. Description of Related Art

Heretofore, in glow engines of two-cycle or four-cycle which have been known as the engine for models, a carburetor 100 having the structure as shown in FIG. 6 as the means for controlling the feeding rate of fuel to a combustion chamber of an engine has been used.

In the housing 101 of the carburetor 100, a valve body 102 having the shape like a cylinder is provided rotatably around the axis line of the valve body 102 itself. A pipe conduit 101*a* and 101*b* extends vertically through the housing 101, and air is supplied from the upper pipe conduit 101*a*. A passage 102*a* extends through the valve body 102, and the passage is communicated to the pipe conduits 101*a* and 101*b* of the housing 101 with the opening dependent on the rotation angle of the valve body 102. An operating arm 103 is connected to a portion of the valve body 102 which projects beyond the one end of the housing 101. An operating part of a servo mechanism not shown in the drawing is connected to the operation arm 103, and the servo mechanism rotates the valve body 102 in the housing 101. A needle 104 is fixed to the valve body 102 with a screw, and the projection into the valve body 102 is adjustable by turning the needle 104.

A fuel control needle valve 105 is built-in at the other end of the housing 101. The needle valve 105 has a tube 106 and a needle 107 provided in the tube 106. The needle 107 is fixed to the tube 106 with a screw, and the needle 107 is moved inversely in the tube 106 by turning a knob 108 provided at the base of the needle, and the tip opening of the tube 106 can be adjusted. The tip of the needle 104 provided to the valve body 102 is facing to the opening of the tip of the tube 106 of the needle valve 105.

Fuel fed to the needle valve 105 is jetted from the clearance between the tip of the tube 106 and the needle 107 to the internal, mixed with air supplied in the valve body 102, and fed to an engine. Because the flow rate of fuel can be adjusted by turning the know of the needle valve 107, the flow rate of fuel (or air-fuel ratio) can be previously set so that the engine rotates at the maximum rotation speed. The servo mechanism rotates the valve body 102 to adjust air flow rate into the valve body 102, and controls the flow rate of fuel fed to the engine.

According to the carburetor 100, when the engine is accelerated rapidly from the low rotation condition such as idling, a lot of air is fed in the valve body, but the supply of fuel can not follow the supply of air, and the balance of air-fuel ratio is unbalanced. The rotation of the engine increases not smoothly and increases slowly, and can be stopped in the bad case. As a whole, the response is not good, the transition from the low rotation speed to high rotation speed or the high rotation speed to low rotation speed requires a long time, it is a disadvantage of the conventional engines. Further, in the case that an engine for models is mounted on a radio control model plane, fuel is fed not adequately to the carburetor due to the adverse effect of centrifugal force caused by flying motion of the model plane, the inadequate feeding of fuel causes the malfunction of the engine.

Inventors of the present invention had invented a novel fuel injection system to be applied to engines for models in order to solve the above-mentioned problem. The fuel injection system injects fuel into a combustion chamber of an engine for models under electronic control. The fuel injection system had been anticipated to supply fuel stably, to maintain the air-fuel ratio in balance, and to attain rapid speed response in an engine for models used in severe operational conditions.

The structure of the above-mentioned fuel injection system 30 which the inventors of the present invention had proposed is described. As shown in FIG. 5, the fuel injection system 30 is provided with an approximately cylindrical box 31. In the box 31, a solenoid coil is accommodated. A power terminal 33 for supplying power to the solenoid coil 32 is projected outside the box 31 through the box 31. A magnetic core 34 is inserted into the solenoid coil 32. A fuel supply passage 35 is formed through the axis of the magnetic core 34. The magnetic core 34 is projected outside the box beyond the base end of the box 31, and a portion of the magnetic core 34 projected outside the box 31 is communicated to the fuel supply conduit 18 guided from the fuel tank 20.

A valve box 36 is provided on the end of the box 31. A fuel injection orifice 37 is formed on the end of the valve box 36. In the box 31, an approximately cylindrical valve body 38 is inserted movably in the solenoid coil 32 adjacent to the magnetic core 34. The valve body 38 is provided with a flow passage 39 communicated to the fuel supply passage 35. A flange 40 is formed on the end of the valve body 38. A ring contact projection 41 for contact with the inside surface of the valve box 36 is provided on the periphery of the front face of the flange 40. A needle 42 is fixed at the center of the front face of the flange 40, and the needle 42 is inserted movably into the fuel injection orifice 37 of the valve body 38.

A plate spring 44 which is a pressing means for pressing the valve body 38 toward the fuel injection orifice 37 is provided between a fixing component 43 of the solenoid coil 32 and the valve box 36. The plate spring 44 comprises an outside ring fixing portion 45, inside ring moving portion 46, and connection arm 47 which connects elastically both portions. The fixing portion 45 is fixed between the fixing component 43 of the solenoid coil 32 and the valve box 36, and the moving portion 46 is fixed to the flange 40 of the valve body 38.

While power is not supplied to the solenoid coil 32, the valve body 38 is pressed toward the fuel injection orifice 37 by the pressing force of the plate spring 44, the contact projection 41 of the flange 40 is brought into contact with the inside surface of the valve body 36, and the fuel injection orifice 37 is closed. When power is supplied to the solenoid coil 32, the solenoid coil 32 attracts and moves magnetically the valve body 38 toward the magnetic core 34 against the pressing force of the plate spring 44. A space is formed between the flange 40 of the valve body 38 and the valve box 36 as the result of such movement. Fuel which is pressurized at a certain pressure in the box 31 is injected from the fuel injection orifice 37 to the outside of the box 31.

Operations of an engine for models to which the fuel injection system 30 is provided is described. Fuel injected from the fuel injection system 30 is mixed with air which is taken in depending on the opening of the throttle valve 14, and fed into a cylinder from an intake valve 17 which is opened at a predetermined timing. A glow plug 19 ignites the air-fuel mixture at a predetermined timing to start combustion. Burnt gas is exhausted outside the cylinder from an exhaust valve 23 which is opened at a predetermined timing.

However, it was found that the above-mentioned novel fuel injection system proposed by the inventors of the present invention had a problem to be solved. The fuel injection system shown in FIG. 5 supplies fuel from the rear end of the box 31 in which the solenoid coil 32 is contained into the internal thereof, the valve body 38 moves in the internal of the solenoid coil 32 filled with fuel to control fuel injection. In such structure, a failure that fuel leaks from the hole of the box 31 through which the power source terminal 33 of the solenoid coil 32 is guided to the outside can happen. Also, because the valve body 38 which receives a force from the solenoid coil is moved in fuel, the motion is slow due to resistance of the fuel, and the resistance can result in slow response speed.

It is the object of the present invention to improve the performance of the novel fuel injection system proposed by the inventors of the present invention, and to prevent leakage of fuel and to improve the response speed of the valve body by isolating the electric system from fuel.

SUMMARY OF THE INVENTION

The fuel injection system of an engine for models according to the present invention is provided with a valve box, a fuel supply passage provided to the valve box, a fuel injection passage provided to the valve box, a communication space provided to the valve box for communicating the supply passage to the injection passage, a flexible opening/closing component fixed to the valve box and disposed in the communication space, a solenoid coil provided adjacent to the valve box with interposition of the opening/closing component, a magnetic core provided in the internal of the solenoid coil, a valve body fixed to the side of the solenoid coil of the opening/closing component for being attracted to the magnetic core while a current is supplied to the solenoid coil to deform the opening/closing component and then to communicate the supply passage to the injection passage, and a pressing means for pressing the valve body in the direction so that the opening/closing component shuts the supply passage and the injection passage.

The fuel injection system of an engine for models according to the present invention is provided with a valve box, a communication space formed on one end of the valve box, a fuel supply passage having an opening facing to the communication space, a fuel injection passage having an opening facing to the communication space, a flexible opening/closing component fixed on one end of the valve box so as to seal the communication space for opening/closing the inlet opening of the injection passage at the central portion of the face of the valve box side, a solenoid coil provided adjacent to the valve box with interposition of the opening/closing component, a magnetic core provided in the internal of the solenoid coil, a valve body fixed to the side of the solenoid coil of the central portion of the opening/closing component for being attracted to the magnetic core while a current is supplied to the solenoid coil to deform the opening/closing component and then to open the inlet opening of the injection passage, and a pressing means for pressing the valve body in the direction so that the opening/closing component closes the inlet opening of the injection passage.

The fuel injection system of an engine for models according to the present invention is provided with a valve box, a communication space formed on one end of the valve box, a fuel supply passage having an opening facing to the communication space, a fuel injection passage having an opening facing to the communication space, a flexible opening/closing component fixed on one end of the valve box so as to seal the communication space for opening/closing the inlet opening of the supply passage at the central portion of the face of the valve box side, a solenoid coil provided adjacent to the valve box with interposition of the opening/closing component, a magnetic core provided in the internal of the solenoid coil, a valve body fixed to the side of the solenoid coil of the central portion of the opening/closing component for being attracted to the magnetic core while a current is supplied to the solenoid coil to deform the opening/closing component and then to open the inlet opening of the supply passage, and a pressing means for pressing the valve body in the direction so that the opening/closing component closes the inlet opening of the supply passage.

The fuel injection system of an engine for models as claimed in claim 4 is provided with the opening/closing component which is substantially a disk like shape, and a ridge is provided on the central portion of the side of the valve box in contact with the valve box for partitioning between the supply passage and the injection passage.

DETAILED DESCRIPTION OF THE PREFERRED EMBODIMENTS

Figure 1:
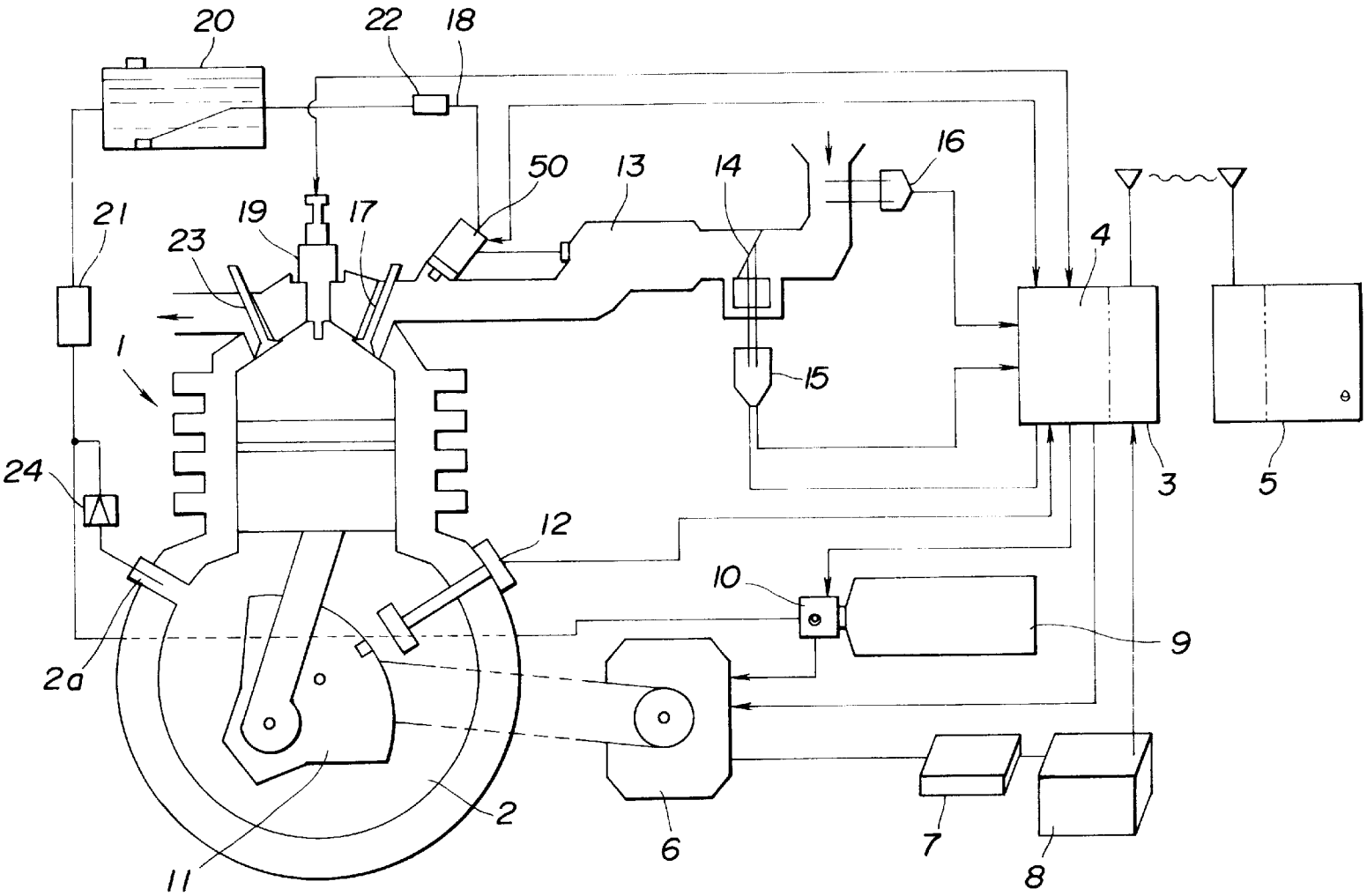
FIG. 1 is a schematic structural view of a four-cycle engine using a fuel injection system of the first example of the embodiment of the present invention.

The first example of the embodiment of the present invention is described in detail hereinafter referring to FIG. 1 and FIG. 2. This embodiment involves an engine for models provided with an electronic controlled fuel injection system. The engine 1 for models (referred to as engine 1 hereinafter) of this embodiment is an engine to be mounted on a radio control model plane. The engine 1 shown in FIG. 1 is a four-cycle engine which uses methyl alcohol fuel containing lubricating oil and ignition accelerating agent such as nitromethane. The capacity of the combustion chamber is in a range from 1 to 30 cc, the pressure caused in the crank chamber 2 during operation pulses in a range from 20 kPa to 100 kPa for the positive peak pressure, and in a range from −20 kPa to −100 kPa for the negative peak pressure. The positive pressure and negative pressure are the value based on the reference of the average pressure in the crank chamber 2.

The engine 1 is controlled by a control means 4 of a receiver 3 mounted on the radio control model plane. When an operator operates the transmitter 5, the receiver 3 receives radio wave from the transmitter 5, and the radio wave controls every parts of the model plane including the engine 1.

The engine 1 shown in FIG. 1 is started up by a starter 6. The starter 6 is driven by power supplied from the battery 8 through a rectifier 7 or auxiliary pressurized air supplied from an air bomb 9. The controller 4 of the radio control receiver 3 controls the starter 6 and switching valve 10 of the air bomb 9.

A rotation detection sensor 12 for detecting the position of the rotating crank 11 as a stroke detection means for detecting the operation cycle of the engine 1 and outputting the stroke signal is provided in the crank chamber 2. The rotation detection sensor 12 detects rotation of the engine 1 for matching the fuel injection timing. The output from the rotation detection sensor 12 is sent to the control means 4 of the radio control receiver 3, and served to control the engine 1.

An intake manifold 13 of the engine 1 is provided with a throttle valve 14 for controlling intake air. A throttle valve driving means 15 controls the opening of the throttle valve. An intake air and temperature sensor 16 is provided at the air intake inlet of the intake manifold 13, the signal generated from the sensor is supplied to the control means 4 of the radio control receiver 3 and used for controlling the engine 1.

The fuel injection system 50 is provided near the intake valve 17 of the intake manifold 13. Pressurized fuel is supplied from the fuel tank 20 to the fuel injection system 50. The internal of the fuel tank 20 and the crank chamber 2 are communicated each other through the check valve 24 and regulator 21, only the positive pressure out of the positive and negative pressure generated in the crank chamber 2 is taken out by the check valve 24, and the pressure is regulated to an approximately constant pressure by the regulator 21. Therefore, an approximately constant pressure is applied to fuel in the fuel tank 20. Further as shown in FIG. 1, the internal of the fuel tank 20 can be pressurized by way of communication of the air pressure of the air bomb to the regulator 21 using the air bomb 9 as a pressurizing means. The pressure applied to fuel in the fuel tank 20 is approximately equal to the positive pressure generated in the crank chamber 2 of the engine 1, in detail, the peak value (the maximum value) is approximately in a range from 20 kPa to 100 kPa. The fuel sent out from the fuel tank 20 is supplied to the fuel injection system 50 through the filter 22.

Next, the fuel injection system 50 of this example is described. The fuel injection system 50 has an approximately cylinder-like valve box 51. A connection hole 52 is formed on the rear end face of the valve box 51, and the opening side of the approximately cylinder-like box 53 is connected to the connection hole 52. In the internal of the connection hole 52, a communication space 54, that is a ring step groove, is formed at the approximately central portion of the rear end face of the valve box 51. In the internal of the valve box 51, a fuel supply passage 55 and fuel injection passage 56 are formed. An inlet opening 57 of the fuel supply passage 55 is provided on the peripheral face of the valve box 51, and an outlet opening 58 is provided on one side of the communication space 54. An inlet 59 of the fuel injection passage 56 is provided at the center of the communication space 54, and an outlet opening 60 is provided on the front end face of the valve box 51. In other words, the supply passage 55 is communicated to the injection passage 56 through the communication space 54. A check valve 61 is provided on the supply passage 55.

A diaphragm 62 is fixed on the rear end face of the valve box 51. The diaphragm 62 is a disk component made of a flexible material. The outside periphery of the diaphragm 62 is fixed by a ring holder 63 between the valve box 51 and box 53, and the diaphragm 62 partitions the space between the communication space 54 of the valve box 51 and the internal of the box 53. In other words, the communication space 54 is sealed from the internal of the box 53. A ring continuous ridge 64 is formed at the central face of the valve box 51 side of the diaphragm 62. The ridge 64 is in contact with the rear end face of the valve box 51 on the periphery of the inlet opening 59 of the injection passage 56, and functions as a partition between the supply passage 55 and injection passage 56. The diaphragm 62 is an opening-closing component for opening and closing the inlet opening 59 of the injection passage 56 in the internal of the communication space 54, and functions to communicate/shut between the supply passage 55 and injection passage 56 by deforming elastically.

A solenoid coil 65 is contained in the internal of the box 53. A magnetic core 66 is fixed with a fixing screw 67 on the rear end of the internal of the solenoid coil 65. A power supply wire 68 of the solenoid coil 65 is guided to the outside from a hole 69 formed on the rear end face of the box 53.

An end of the valve body 70 is fixed on the rear end face of the diaphragm 62, namely the center of the face of the side facing to the solenoid coil 65 of the diaphragm 62. The valve body 70 is a cylinder-like component having a flange **70*a* at the end, and the rear side is inserted into the solenoid coil 65. Between the front end face of the solenoid coil 65 and the holder 63, a plate spring 71, which functions as a pressing means, is provided and fixed with interposition of a spacer 72. The outside of the plate spring 71 is fixed between the spacer 72 and the holder 63, and the inside of the plate spring 71 is engaged with the flange 70*a* of the valve body 70. The plate spring 71 presses the valve body 70 toward the valve box 51** side.

Next, operation of this example is described.

As shown in FIG. 1, the engine 1 for models of the embodiment is a four-cycle engine, the operation is continued by repeating suction stroke, compression stroke, explosion stroke, and exhaust stroke. The air pressure in the crank chamber 2 fluctuates due to reciprocating motion of the piston P during operation. The pressure in the crank chamber 2 is reduced when the piston P goes up during an exhaust stroke. The pressure in the crank chamber 2 is increased when the piston P goes down during a suction stroke. The pressure in the crank chamber 2 is reduced when the piston P goes up during a compression stroke. The pressure in the crank chamber 2 is increased when the piston P goes down during an explosion stroke. As described herein above, the pulsatory pressure (air pressure) is generated in the crank chamber 2 in response to the motion of the piston P. The pulsatory air pressure pulses in a range having the positive pressure peak value of about 20 kPa to 100 kPa and having the negative pressure peak value of −20 kPa to −100 kPa based on the reference of the average pressure in the crank chamber 2.

Only the positive pressure out of the pulsatory air pressure supplied from the crank chamber 2 is taken out by the check valve, further taken out through the regulator 21, and is applied to fuel in the fuel tank 20 as the positive pressure with reduced pressure variation. The pressurized fuel in the fuel tank 20 is supplied to the fuel injection system 50.

A driving signal is given to the solenoid coil 65 of the fuel injection system 50 synchronously with the operation stroke of the engine 1. While a current is not supplied to the solenoid coil 65, the plate spring 71 presses the valve body 70 toward the valve box 51 side. The ridge 64 of the diaphragm 62 combined with the valve body 70 is in contact with the front end face of the valve box 51, and closes the inlet opening 59 of the injection passage 56. Therefore, the pressurized fuel is remained in the internal of the valve body 51 and is not injected.

When a current is supplied to the solenoid coil 65, the valve body 70 is brought into contact with the magnetic core 66 magnetically. The central portion of the diaphragm 62 combined with the valve body 70 is deformed elastically toward the box 53 side. The ridge 64 of the diaphragm 62 leaves from the front end face of the valve box 51, and the inlet opening 59 of the injection passage 56 is communicated to the outlet opening 58 of the supply passage 55 through the communication space 54. Therefore, the pressurized fuel passes through the internal of the valve box 51 and is injected from the injection passage 56 toward the inside of a cylinder.

According to the fuel injection system 50 of this example, because the space in the valve box 51 for retaining fuel is partitioned from the space in the box 53 containing the solenoid coil 65 and valve body 70 by the diaphragm 62, the valve body 70 does not receive the resistance of fuel when the valve body is moved. Therefore, in comparison with the fuel injection system 30 having the valve body 70 which moves in fuel previously proposed by the inventors of the present invention, the relatively smaller force of the solenoid coil is sufficient for driving.

Fuel is sealed in the valve body 51, and does not enter into the box 53 which contains the solenoid coil 65, and the fuel therefore will not leak through the hole 69 of the box 53 for guiding the power supply wire 68 of the solenoid coil 65 to the outside.

According to the fuel injection system 50 of this example, the engine responses sensitively to operation of the model, and does not stall due to deficient fuel supply and excess fuel supply.

Figure 3:
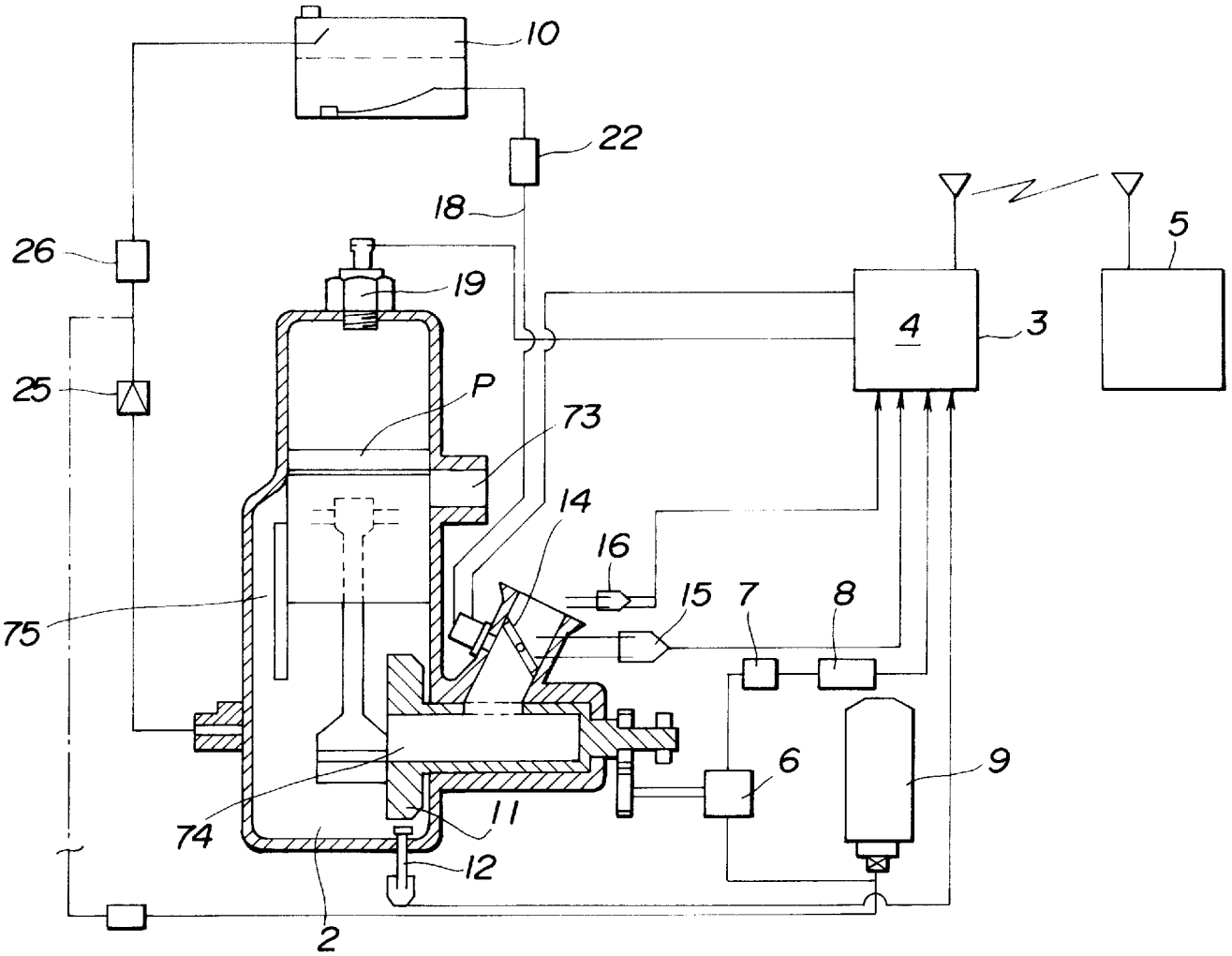
FIG. 3 is a schematic structural view of a two-cycle engine using the fuel injection system of the second example of the embodiment of the present invention.

The second example of the embodiment of the present invention is described with reference to FIG. 3.

This example involves a two-cycle engine for models provided with an electronic controlled fuel injection system. A two-cycle engine has neither intake valve 65 nor exhaust valve unlike a four-cycle engine, an exhaust vent 73, intake port 74, and scavenging port 75 are formed on a cylinder directly as shown in FIG. 3, and a piston P itself operates opening-closing of these ports. The same functional components in FIG. 3 as shown in FIG. 1 are given the same characters shown in FIG. 1, and detailed description is omitted. The fuel injection system 50 of this example has the same structure as described in the first example, and as shown in FIG. 3, the fuel injection system 50 is attached on the carburetor side (throttle vavle 14 side).

When the piston P goes down with explosion of combustion gas, the exhaust vent 73 is opened to start discharging of combustion gas, then the scavenging port 75 is opened. The pressure in the cylinder is lowered and the pressure in the crank chamber 2 is increased. The air in the crank chamber 2 flows into the cylinder from the opened scavenging port 75, and excludes combustion gas in the cylinder through the exhaust vent 73. When the piston P turns to go up, the pressure in the crank chamber 2 becomes negative, air begins to flow from the intake port 74 into the crank chamber 2. When the piston P goes up to the top dead center, the piston P closes the exhaust vent 70 and scavenging port 72 to make the internal of the cylinder air tight, and air-fuel mixture in the cylinder is compressed. When the piston P comes to the top dead point, the glow plug 19 ignites the air-fuel mixture to start combustion. The explosion force forces the piston P to turn to go down, and the engine enters to an exhaust stroke. In this example, because the fuel injection system 50 is attached on the throttle valve 14 side, the fuel injection system 50 is actuated from the end of an intake stroke, and injects atomized fuel into the crank chamber 2 during a compression stroke.

The third example of the embodiment of the present invention is described with reference to FIG. 4.

Figure 2:
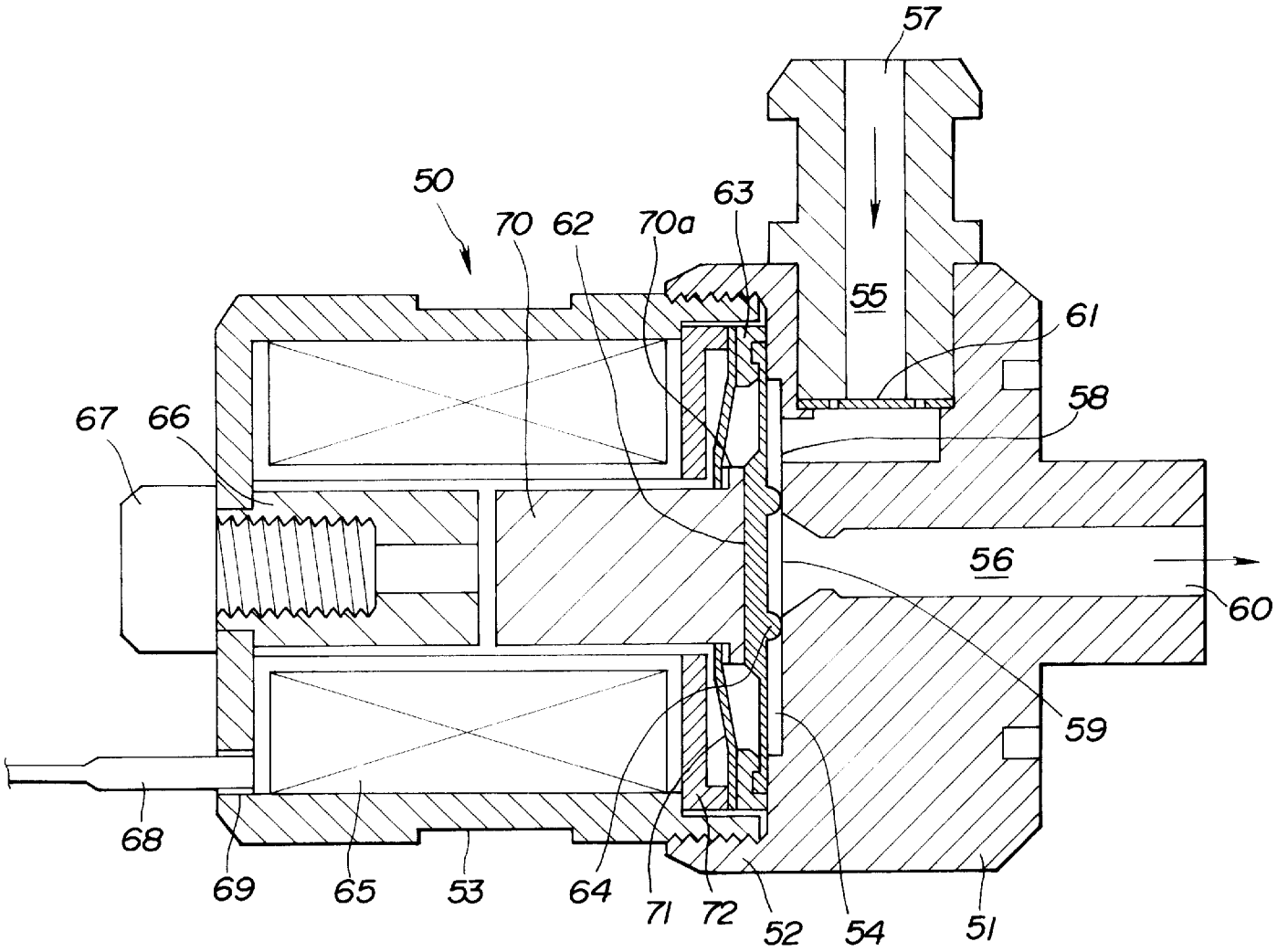
FIG. 2 is a cross-sectional view of the fuel injection system of the first example of the embodiment of the present invention.

The fuel injection system 80 of this example is a fuel injection system that the fuel injection system 50 described in the first and second examples shown in FIG. 2 is further improved. In the fuel injection system 50 shown in FIG. 2, fuel enters from the outlet opening 58 of the supply passage 55 disposed facing to the outside of the circular diaphragm 62 and goes out from the inlet opening 59 of the injection passage 56 disposed facing to the inside of the central ridge 64. In the fuel injection system 80 of the third example shown in FIG. 4, conversely, fuel enters from the outlet opening 82 of the supply passage 81 disposed facing to the inside of the ridge 64 on the central side of the circular diaphragm 62 and goes out from the inlet opening 84 of the injection passage 83 disposed facing to the outside of the ridge 64. Though the structure is different, the components shown in FIG. 4 corresponding to the components shown in FIG. 2 are given the same characters as given in FIG. 2, and detailed description is omitted.

Because fuel is pressurized at a constant pressure, a pressure applied to the diaphragm 62 by the fuel remaining stopped in the valve box 51 while injection is not operated is proportional to the area where the diaphragm 62 is in contact with the pressurized fuel. As the area where the diaphragm 62 is in contact with the pressurized fuel is smaller, the plate spring 71 having a smaller pressing force is sufficient for pressing the diaphragm 62 onto the valve box 51 to stop the fuel.

Figure 4:
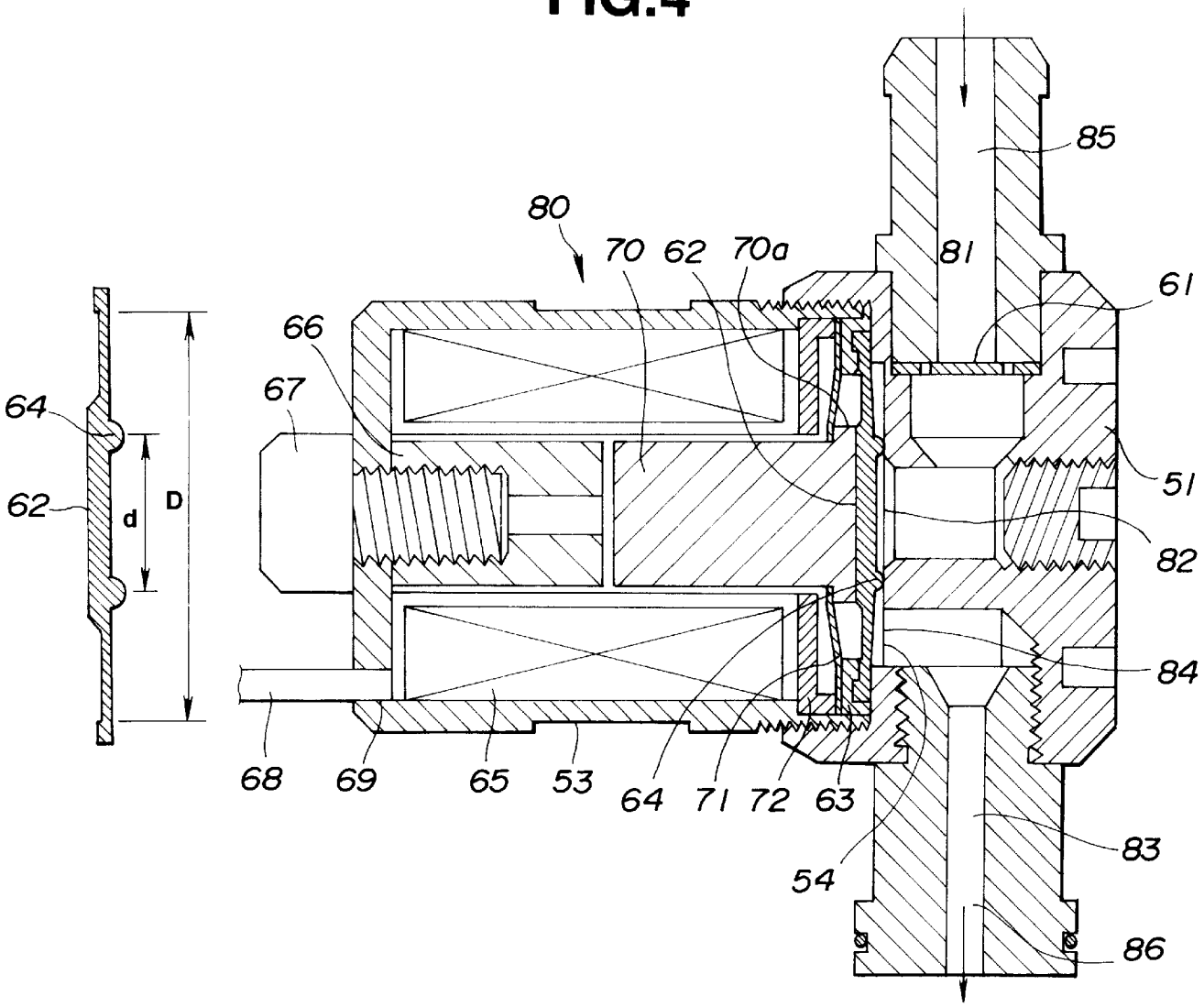
FIG. 4 is a cross-sectional view of the fuel injection system of the second example of the embodiment of the present invention.
Figure 5:
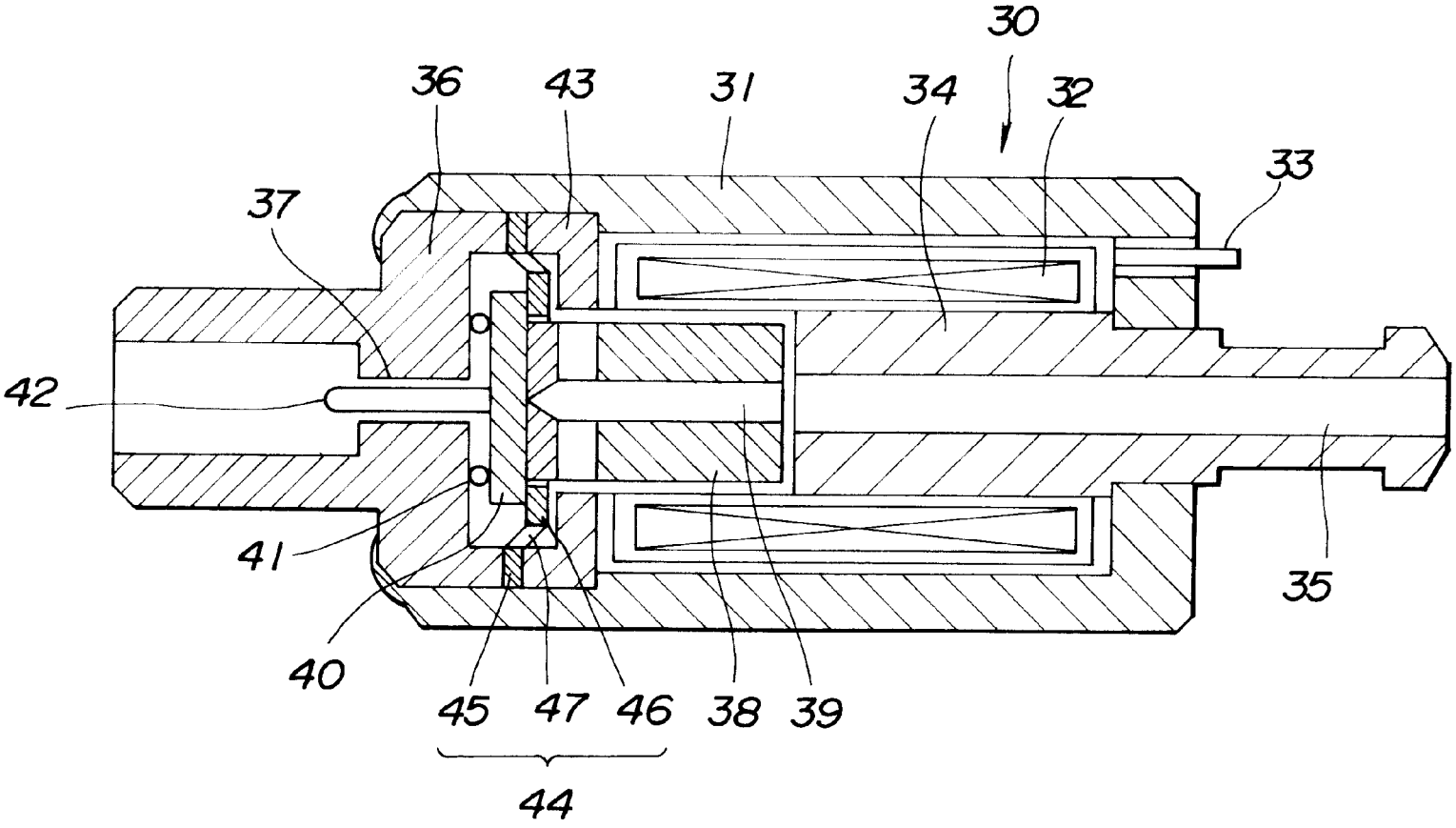
FIG. 5 is a cross-sectional view of the fuel injection system proposed by the inventors of the present invention.
Figure 6:
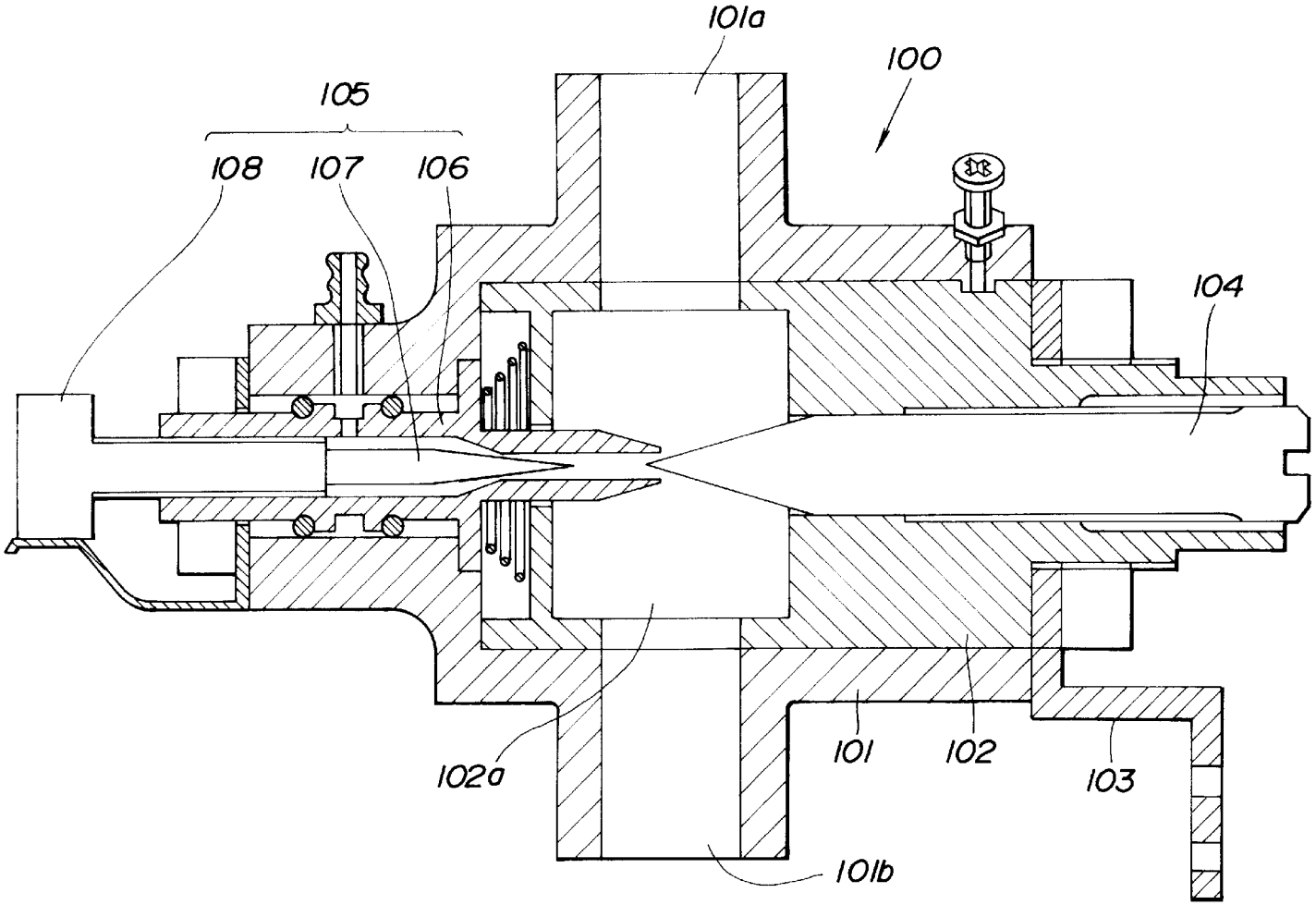
FIG.6 (PRIOR ART)
FIG. 6 is a cross-sectional view of the conventional throttle valve.

As shown in FIG. 4(*b*), assuming that the diameter of deformable portion of the circular diaphragm 62 is D and the diameter of the ridge 64 is d, a force of fuel exerted onto the outside ring portion of the ridge 64 is proportional to the area of the outside ring portion of the ridge 64, namely $\pi\{(D/2)^2-(d/2)^2\}$. The force exerted on the inside circular portion of the ridge 64 is proportional to the area of the inside circular portion of the ridge 64, namely $\pi(d/2)^2$.

In view of the popular size of solenoid coils usable for a fuel injection system of an engine for models and the diameter of injection passage suitable for supplying fuel to an engine for models, the diameter of the diaphragm 62 and diameter of the ridge 64 are determined, the result gives generally the following equation (1) for the relation between the above-mentioned two areas of the two portions of the diaphragm 62.

$$\pi\{(D/2)^2-(d/2)^2\}>\pi(d/2)^2 \quad (1)$$

The following is the reason for holding the above-mentioned relation (1). First, the diameter of the valve body 70 is necessary to be suitable for the diameter of the ridge 64 which is functions as a sealing component. If the diameter of the ridge is larger than the diameter of the valve body, the diaphragm 62 is deflected when the valve is closed and sealing function is not consistent, and therefore, in order to seal consistently fuel using a valve having a small diameter which is actuated by a solenoid valve with a low power consumption, it is necessary to use the ridge 64 having a diameter suitable for the diameter of the valve body and to press the ridge onto the valve box 51 side by exerting a force onto the ridge from the back side of the diaphragm. Next, the distance between fixed portion on the outside periphery of the diaphragm 62 and the ridge 70 which functions as a sealing component is desirably longer. The reason for such longer distance is that the longer distance allows the diaphragm 62 to be deformed with a smaller force when the valve is opened to introduce fuel. Accordingly to the above-mentioned two reasons, it is advantageous that the diameter of the central ridge 70 which functions as a sealing component is designed to be small relative to the whole diameter of the diaphragm 62.

In the fuel injection system shown in FIG. 2 to which the above-mentioned size relation is applied, because the fuel pressure is exerted on the outside ring portion of the diaphragm 62 having a larger area, a larger force is exerted on the valve body 70 in comparison with the case that the force is exerted on the inside portion of the ridge 64. Therefore to stop injection of the fuel, the corresponding pressing force of the plate spring 71 is required. As the result, a large attraction force of the solenoid coil 65 is required to move the valve body 70 against the pressing force. However, in the case that the area of the above-mentioned outside ring portion is smaller than the area of the circular inside portion of the ridge 64, a plate spring 71 having a relatively small pressing force can be used and a solenoid coil having a small attraction force can be used in the fuel injection system 50 shown in FIG. 2 having a diaphragm 62 that fuel pressure is exerted on the outside ring portion of the diaphragm 62.

In the case that the above-mentioned equation (1) holds and a fuel injection system 80 of this example shown in FIG. 4 is used, the force exerted on the valve body 70 is small because the fuel pressure is exerted on the inside portion of the ridge 64 having a smaller area in comparison with the case that the fuel pressure is exerted on the outside ring portion of the diaphragm 62. Therefore, a small pressing force of the plate spring 71 used for stopping fuel injection is sufficient for performing the function, and as the result, a small attraction force of the solenoid coil 65 is sufficient for moving the valve body 70 against the pressing force.

According to the fuel injection system 80 of this example shown in FIG. 4, the fuel injection system 80 can be attached on the engine for models in the different direction from the fuel injection system 50 shown in FIG. 2 which has the injection passage 83 projected in the axial direction of the solenoid coil 65 because the inlet opening 85 of the fuel supply passage 81 and the outlet opening 86 of the injection passage 83 are provided facing to the same direction, namely the peripheral face of the valve box 51. Any one of the fuel injection system 50 and the fuel injection system 80 may be selected in view of the effective utilization of the space around the engine for models.

The fuel injection systems 50 and 80 described in the respective examples hereinbefore can be provided to an engine for models to be mounted on a radio controlled model. The model is not limited to radio controlled model planes for hobby but also includes various movable bodies used in industrial fields on which a relatively small engine is mounted, in detail, includes model automobiles and model boats.

According to the fuel injection system of an engine of the present invention, a flexible opening/closing component is provided between the electric system and fuel side as a partition, and the opening/closing component is deformed to perform ON/OFF control of fuel by the valve body driven with aid of the solenoid coil. Therefore, according to the present invention, the separation of the electric system and fuel prevents fuel from leaking, and the attraction force of the solenoid coil is used efficiently and the high speed response is realized because the valve body does not receive resistance force from fuel. In spite of severe using condition of the engine for models, fuel is supplied stably and air-fuel ratio is maintained balanced, high speed response is realized, and thus the performance of a radio control moving body is improved.

What is claimed is:

1. A fuel injection system of an engine for models provided with a valve box, a fuel supply passage provided to said valve box, a fuel injection passage provided to said valve box, a communication space provided to said valve box for communicating said supply passage to said injection passage, a flexible opening/closing component fixed to said valve box and disposed in said communication space, a solenoid coil provided adjacent to said valve box with interposition of said opening/closing component, a magnetic core provided in the internal of said solenoid coil, a valve body fixed to the side of said solenoid coil of said opening/closing component for being attracted to said magnetic core while a current is supplied to said solenoid coil to deform said opening/closing component and then to communication said supply passage to said injection passage, and a pressing means for pressing said valve body in the direction so that said opening/closing component shuts said supply passage and said injection passage when no current is supplied to said solenoid coil.

2. A fuel injection system of an engine for models provided with a valve box, a communication space formed on one end of said valve box, a fuel supply passage having an opening facing to said communication space, a fuel injection passage having an opening facing to said communication space, a flexible opening/closing component fixed on one end of said valve box so as to seal said communication space for opening/closing the inlet opening of said injection passage at the central portion of the face of said valve box side, a solenoid coil provided adjacent to said valve box with interposition of said opening/closing component, a magnetic core provided in the internal of said solenoid coil, a valve body fixed to the side of said solenoid coil of the central portion of said opening/closing component for being attracted to said magnetic core while a current is supplied to said solenoid coil to deform said opening/closing component and then to open the inlet opening of said injection passage, and a pressing means for pressing said valve body in the direction so that said opening/closing component closes the inlet opening of said injection passage when no current is supplied to said solenoid coil.

3. A fuel injection system of an engine for models provided with a valve box, a communication space formed on one end of said valve box, a fuel supply passage having an opening facing to said communication space, a fuel injection passage having an opening facing to said communication space, a flexible opening/closing component fixed on one end of said valve box so as to seal said communication space for opening/closing the inlet opening of said supply passage at the central portion of the face of said valve box side, a solenoid coil provided adjacent to said valve box with interposition of said opening/closing component, a magnetic core provided in the internal of said solenoid coil, a valve body fixed to the side of said solenoid coil of the central portion of said opening/closing component for being attracted to said magnetic core while a current is supplied to said solenoid coil to deform said opening/closing component and then to open the inlet opening of said supply passage, and a pressing means for pressing said valve body in the direction so that said opening/closing component closes the inlet opening of said supply passage when no current is supplied to said solenoid coil.

4. The fuel injection system of an engine for models as claimed in claim 1 or claim 2 or claim 3, wherein said opening/closing component has substantially a disk like shape, and a ridge is provided on the central portion of the side of said valve box in contact with said component for partitioning between said supply passage and said injection passage.

* * * * *

UNITED STATES PATENT AND TRADEMARK OFFICE

CERTIFICATE OF CORRECTION

PATENT NO. : 6,006,728
DATED : December 28, 1999
INVENTOR(S) : Norio Matsuda et al.

It is certified that error appears in the above-identified patent and that said Letters Patent is hereby corrected as shown below:

Title page,
Item [30], the Foreign Application Priority Data has been omitted. It should read as follows:
-- [30] Foreign Application Priority Data
Nov. 6, 1996 [JP] Japan ..... 8-293931 --

Signed and Sealed this

Twenty-fifth Day of December, 2001

*Attest:*

*Attesting Officer*

JAMES E. ROGAN
*Director of the United States Patent and Trademark Office*